US011506018B2

(12) United States Patent
Odegbami

(10) Patent No.: US 11,506,018 B2
(45) Date of Patent: Nov. 22, 2022

(54) STEERING ASSEMBLY CONTROL VALVE

(71) Applicant: Halliburton Energy Services, Inc., Houston, TX (US)

(72) Inventor: Olumide O. Odegbami, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 16/619,174

(22) PCT Filed: Jul. 6, 2017

(86) PCT No.: PCT/US2017/040981
§ 371 (c)(1),
(2) Date: Dec. 4, 2019

(87) PCT Pub. No.: WO2019/009911
PCT Pub. Date: Jan. 10, 2019

(65) Prior Publication Data
US 2020/0199970 A1 Jun. 25, 2020

(51) Int. Cl.
*E21B 34/06* (2006.01)
*E21B 7/06* (2006.01)

(52) U.S. Cl.
CPC ..... *E21B 34/066* (2013.01); *E21B 7/06* (2013.01)

(58) Field of Classification Search
CPC ..... E21B 34/06; E21B 34/14; E21B 34/066; E21B 7/06
See application file for complete search history.

(56) References Cited

U.S. PATENT DOCUMENTS 5,603,385 A 2/1997 Colebrook
6,789,516 B2 9/2004 Coates
(Continued)

FOREIGN PATENT DOCUMENTS

EP 0530045 3/1993
GB 2486808 6/2012
(Continued)

OTHER PUBLICATIONS

ISRWO International Search Report and Written Opinion for PCT/US2017/040981 dated Dec. 27, 2017.
(Continued)

*Primary Examiner* — Nicole Coy
(74) *Attorney, Agent, or Firm* — Benjamin Ford; C. Tumey Law Group PLLC

(57) ABSTRACT

Control valves can allow a well operator to steer a drill string. An exemplary control valve can include a valve body with an axial bore and a radial orifice in fluid communication with the axial bore, wherein flow passing through the axial bore passes through the radial orifice and into a piston flow channel to be in fluid communication with a piston bore to exert pressure against a piston movable within the piston bore, the piston being coupled a steering pad for applying force against the wellbore wall. A rotary valve element is disposed within the axial bore and including an actuation flow channel, wherein the rotary valve element is rotatable with respect to the axial bore to change flow through the actuation channel and the radial orifice to modify fluid pressure within the piston flow channel that is exerted against the piston.

23 Claims, 11 Drawing Sheets

(56) References Cited

U.S. PATENT DOCUMENTS

| | | | | |
|---|---|---|---|---|
| 7,195,225 | B1 | 3/2007 | Holliday | |
| 8,376,067 | B2 | 2/2013 | Downton et al. | |
| 8,869,916 | B2 * | 10/2014 | Clausen | E21B 7/06 175/61 |
| 9,016,400 | B2 * | 4/2015 | Clausen | E21B 7/06 175/61 |
| 9,476,263 | B2 * | 10/2016 | Clausen | E21B 10/322 |
| 10,316,598 | B2 * | 6/2019 | Rushton | F16K 11/076 |
| 10,550,689 | B2 * | 2/2020 | Ritchie | E21B 34/06 |
| 2007/0221409 | A1 | 9/2007 | Hall et al. | |
| 2009/0086576 | A1 | 4/2009 | Downton et al. | |
| 2012/0160565 | A1 | 6/2012 | Downton et al. | |
| 2015/0107902 | A1 | 4/2015 | Downton | |
| 2016/0002978 | A1 | 1/2016 | Rushton | |
| 2016/0084007 | A1 * | 3/2016 | Sugiura | E21B 17/1092 175/61 |
| 2019/0345796 | A1 * | 11/2019 | Hall | E21B 41/0085 |

FOREIGN PATENT DOCUMENTS

| | | |
|---|---|---|
| GB | 2486811 | 6/2012 |
| WO | 1999028587 | 6/1999 |

OTHER PUBLICATIONS

Extended European Search Report for Application No. EP17916597 dated Sep. 30, 2020.

* cited by examiner

STEERING ASSEMBLY CONTROL VALVE

TECHNICAL FIELD

The present description relates in general to wellbore drilling and more particularly to, for example, without limitation, to directional control of a rotary steerable drilling assembly using a control valve.

BACKGROUND OF THE DISCLOSURE

In the oil and gas industry, wellbores are commonly drilled to intercept and penetrate particular subterranean formations to enable the efficient extraction of embedded hydrocarbons.

To reach desired subterranean formations, it is often required to undertake directional drilling, which entails dynamically controlling the direction of drilling, rather than simply drilling a nominally vertical wellbore path. Directionally-drilled wellbores can include portions that are vertical, curved, horizontal, and portions that generally extend laterally at any angle from the vertical wellbore portions.

Figure 1A:
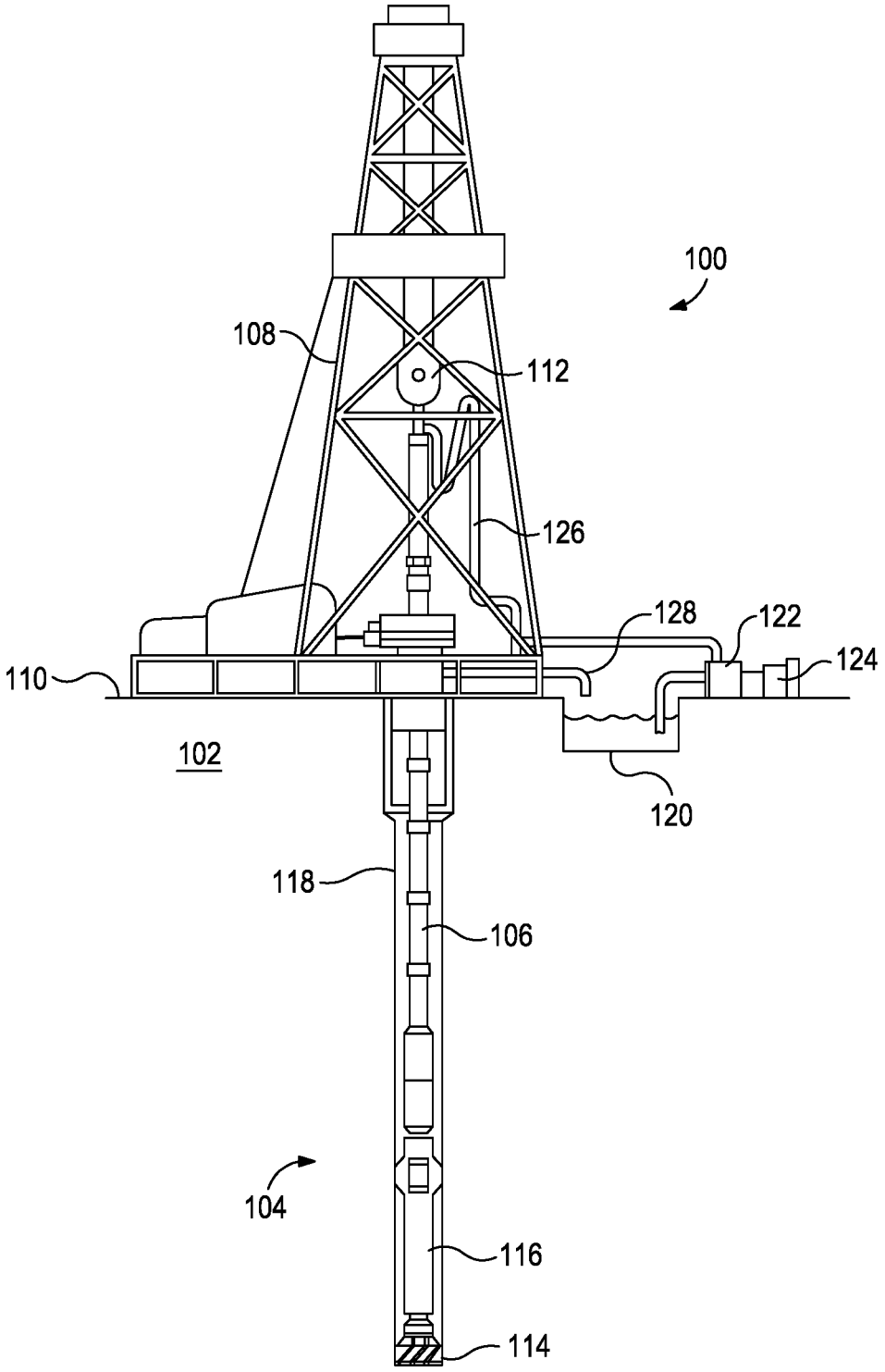
FIG. 1A is an elevation view of a drilling system, according to some embodiments of the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure is related to wellbore drilling and, more specifically, to directional control of a rotary steerable drilling assembly using a control valve.

A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push the drill string against the wall of the wellbore, thereby offsetting the drill bit with respect to the wellbore axis. While drilling a straight section, the actuation mechanism remains disengaged so that there is generally no pushing against the formation. As a result, the drill string proceeds generally concentric to the wellbore axis. Yet another directional drilling technique, generally referred to as the "push to point," encompasses a combination of the "point the bit" and "push the bit" methods. Rotary steerable systems may utilize a plurality of steering pads that can be actuated in a lateral direction to control the direction of drilling, and the steering pads may be controlled by a variety of valves and control systems.

According to at least some embodiments disclosed herein is the realization that a rotary valve element rotating within a seal could be utilized to minimize seal wear due to valving system design and implementation. Further, according to at least some embodiments disclosed herein is the realization that a rotary valve element allows for open bore areas, which minimize pressure drop across a rotary steering device.

FIG. 1A is an elevation view of an exemplary drilling system 100 that may employ one or more principles of the present disclosure. Wellbores may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick or rig 108 arranged at the surface 110. The derrick 108 includes a traveling block 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1A.

Drilling fluid ("mud") from a mud tank 120 may be pumped downhole using a mud pump 122 powered by an adjacent power source, such as a prime mover or motor. The mud may be pumped from the mud tank 120, through a standpipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the standpipe 126 once again.

Although the drilling system 100 is shown and described with respect to a rotary drill system in FIG. 1A, those skilled in the art will readily appreciate that many types of drilling systems can be employed in carrying out embodiments of the disclosure. For example, drills and drill rigs used in embodiments of the disclosure may be used onshore (as depicted in FIG. 1A) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

While not specifically illustrated, those skilled in the art will readily appreciate that the BHA 104 may further include various other types of drilling tools or components such as, but not limited to, a steering unit, one or more stabilizers, one or more mechanics and dynamics tools, one or more drill collars, one or more accelerometers, one or more magnetometers, and one or more jars, and one or more heavy weight drill pipe segments.

Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore construction for river crossing tunneling and other such tunneling wellbores for near surface construction purposes or wellbore u-tube pipelines used for the transportation of fluids such as hydrocarbons.

Figure 1B:
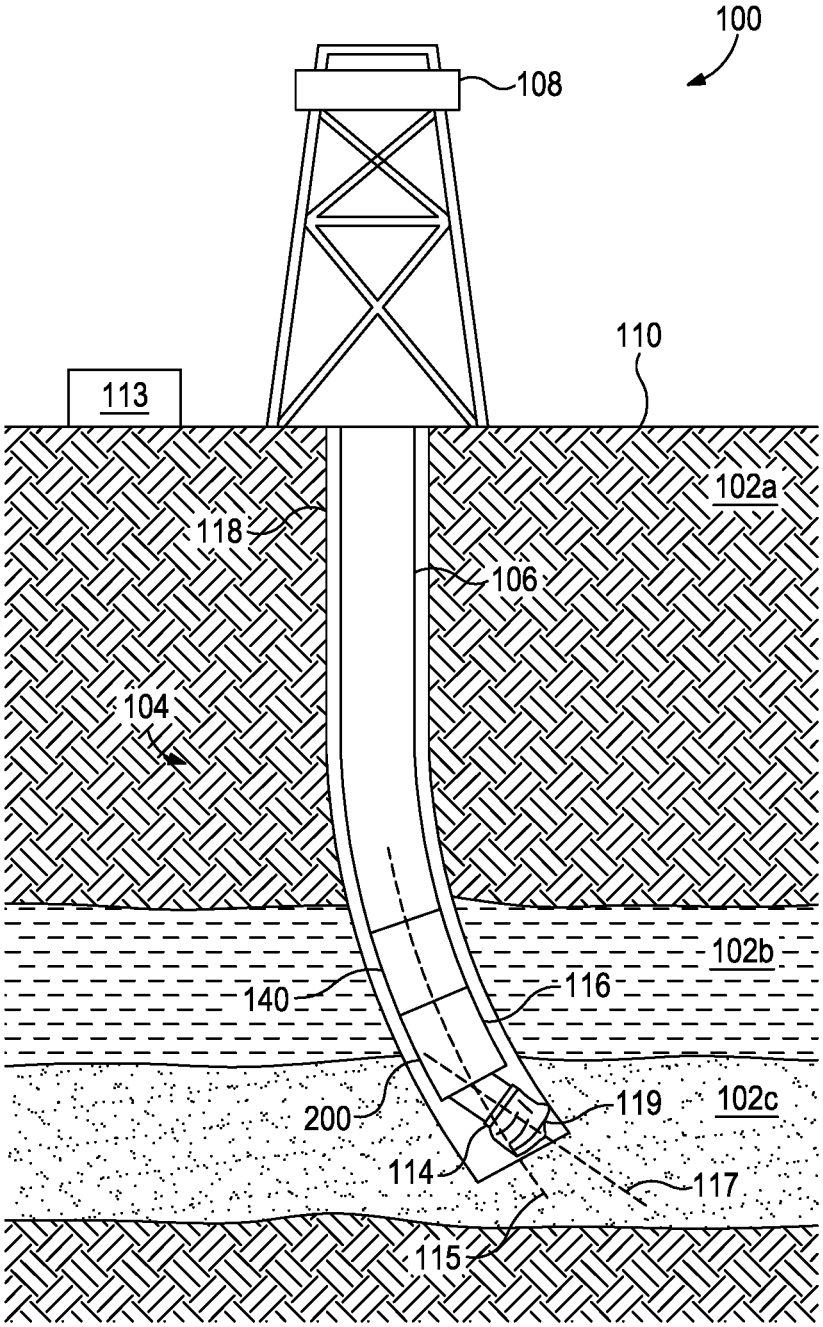
FIG. 1B is an elevation view of a drilling system, according to some embodiments of the present disclosure.

FIG. 1B is an elevation view of an exemplary drilling system 100 that may employ one or more principles of the present disclosure. Referring now to FIG. 1B, illustrated is an exemplary bottom hole assembly (BHA) 104 of an exemplary drilling system 100 that can be used in accordance with one or more embodiments of the present disclosure. The drilling system 100 includes the derrick 108 mounted at the surface 110 and positioned above the wellbore 118 that extends within first, second, and third subterranean formations 102*a*, 102*b*, and 102*c* of the earth 102. In the embodiment shown, a drilling system 100 may be positioned within the wellbore 118 and may be coupled to the derrick 108. The BHA 104 may include a drill bit 114, a measurement-while-drilling (MWD) apparatus 140 and a steering assembly 200. The steering assembly 200 may control the direction in which the wellbore 118 is being drilled. As will be appreciated by one of ordinary skill in the art in view of this disclosure, the wellbore 118 can be drilled in the direction perpendicular to the tool face 119 of the drill bit 114, which corresponds to the longitudinal axis 117 of the drill bit 114. Accordingly, controlling the direction of the wellbore 118 may include controlling the angle between the longitudinal axis 117 of the drill bit 114 and longitudinal axis 115 of the steering assembly 200, and controlling the angular orientation of the drill bit 114 relative to the earth 102.

According to one or more embodiments, the steering assembly 200 may include an offset mandrel (not shown in FIG. 1B) that causes the longitudinal axis 117 of the drill bit 114 to deviate from the longitudinal axis 115 of the steering assembly 200. The offset mandrel may be counter-rotated relative to the rotation of the drill string 106 to maintain an angular orientation of the drill bit 114 relative to the earth 102.

According to one or more embodiments, the steering assembly 200 may receive control signals from a control unit 113. According to one or more embodiments, as shown in FIG. 1B, the control unit 113 can be located at a surface 110 and placed in communication with operating components of the BHA 104. Alternatively or in combination, the control unit 113 can be located within or along a section of the BHA 104. The control unit 113 may include an information handling system with a processor and a memory device, and may communicate with the steering assembly 200 via a telemetry system. According to one or more embodiments, as will be described below, the control unit 113 may transmit control signals to the steering assembly 200 to alter the longitudinal axis 115 of the drill bit 114 as well as to control counter-rotation of portions of the offset mandrel to maintain the angular orientation of the drill bit 114 relative to the earth 102. As used herein, maintaining the angular orientation of a drill bit relative to the earth 102 may be referred to as maintaining the drill bit in a "geo-stationary" position. According to one or more embodiments, a processor and memory device may be located within the steering assembly 200 to perform some or all of the control functions. Moreover, other BHA 104 components, including the MWD apparatus 140, may communicate with and receive instructions from control unit 113.

According to one or more embodiments, the drill string 106 may be rotated to drill the wellbore 118. The rotation of the drill string 106 may in turn rotate the BHA 104 and the drill bit 114 with the same rotational direction and speed. The rotation may cause the steering assembly 200 to rotate about its longitudinal axis 115, and the drill bit 114 to rotate around its longitudinal axis 117 and the longitudinal axis 115 of the steering assembly 200. The rotation of the drill bit 114 about its longitudinal axis 117 may be desired to cause the drill bit 114 to cut into the formation. The rotation of the drill bit 114 about the longitudinal axis 115 of the steering assembly 200 may be undesired in certain instances, as it changes the angular orientation of the drill bit 114 relative to the earth 102. For example, when the longitudinal axis 117 of the drill bit 114 is at an angle from the longitudinal axis of the drill string 115, as it is in FIG. 1B, the drill bit 114 may rotate about the longitudinal axis 115 of the steering assembly 200, preventing the drilling assembly from drilling at a particular angle and direction to the tool face.

Figure 2:
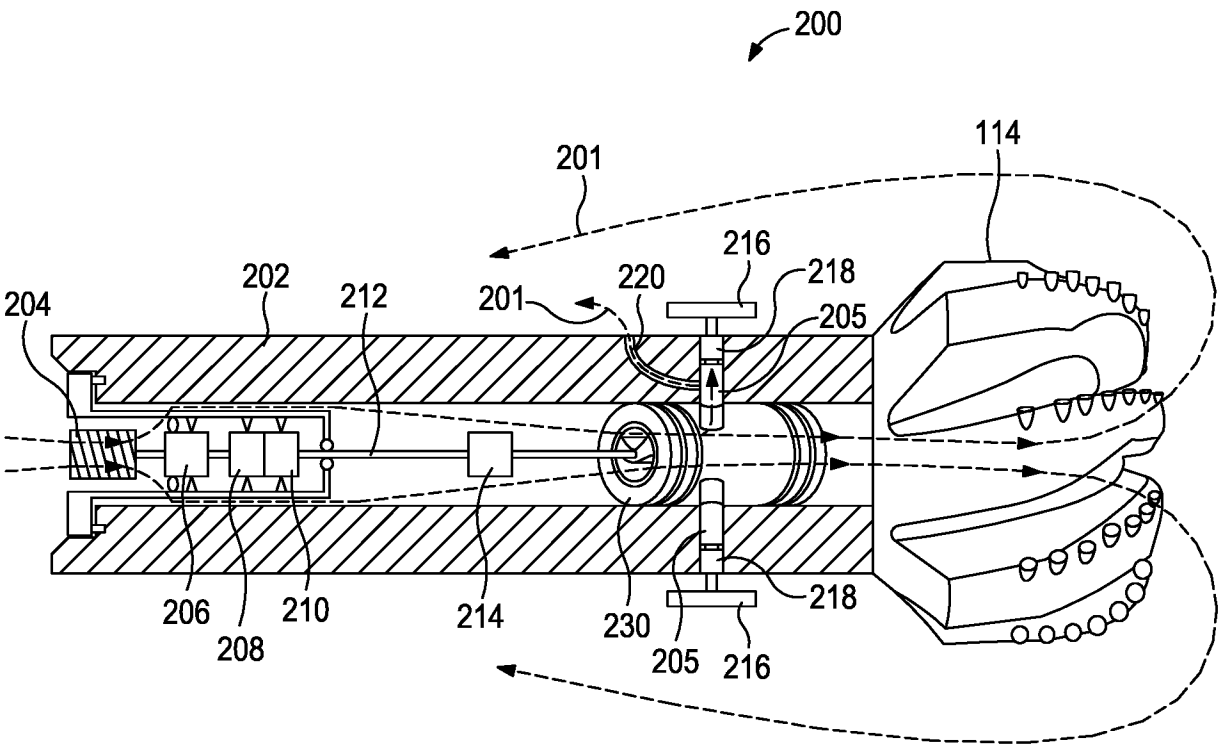
FIG. 2 is a sectional view of a steering assembly, according to some embodiments of the present disclosure.

FIG. 2 is a schematic diagram of an exemplary steering assembly 200 that can employ one or more principles of the present disclosure. In the depicted example, the steering assembly 200 includes a steering assembly body 202 and a control system for directing a drilling fluid flow 201 for actuating one or more steering actuators, such as pistons. The control system can include a powered turbine 204, a generator 206, the controller 208, a motor 210, and a control valve 230. The control system utilizes the control valve 230 to direct drilling fluid flow 201 to exert pressure against the pistons 218 in order to urge the pads 216, thereby steering the drill string and the drill bit 114 in a desired direction or azimuthal orientation.

The steering assembly body 202 can be a generally tubular body, which can receive a drilling fluid flow 201. The drilling fluid flow 201 can pass through the steering assembly body 202 to be received by the drill bit 114. The drilling fluid flow 201 can circulate through the drill bit 114 and flow into an annulus between the drill string and the wellbore being drilled. The steering assembly 200 includes one or more pads 216. The pads 216 are urged to contact the formation to push the drill string against the wellbore wall. The steering assembly 200 can include any suitable number of pads 216 to deflect the steering assembly. In certain embodiments, the steering assembly 200 includes three pads 216. The pads 216 can be controlled by the control valve 230, the controller 208, and the motor 210 to determine a direction of the drill string.

For example, in the depicted example, each pad 216 corresponds to and is coupled to a respective piston 218. The steering assembly 200 includes tubing or piston flow channels 205 to direct drilling fluid to the steering actuators to exert pressure against the pistons 218, thereby extending the pads 216 radially or laterally relative to steering assembly body 202 and into contact with the pads 216. Thus, each piston 218 can be actuated via drilling fluid flow 201.

As described herein, the fluid flow to each piston 218 is controlled via the control valve 230. In addition to the piston flow channels 205, the assembly 200 can include piston bores in which the respective pistons 218 reciprocate. The drilling fluid is directed by the steering assembly 200, via the control valve 230, through the piston flow channels 205 and into one or more piston bores to drive the pistons 218 axially relative to and away from the longitudinal axis of the assembly 200, which in turn radially extends the pads 218 outwardly relative to the longitudinal axis.

Further, after the fluid flow 201 passes through the control valve 230 and into the piston flow channels 205 to exert pressure against and actuate the pistons 218, the fluid can be bled off from the control system. Fluid passing through the piston flow channels 205 can also move toward a fluid exhaust port 220 to be discharged from the assembly 200. The fluid exhaust ports 220 can be formed in the steering assembly body 202 and in fluid communication with the piston flow channels 205 to allow drilling fluid flowing through the piston flow channels 205 to exit the assembly 200. The fluid exhaust ports 220 can allow for pressure to be relieved from the piston flow channels 205 and, when the control valve 230 permits less flow or obstructs flow toward a given piston 218, the fluid exhaust port 220 associated with the piston flow channels 205 will permit pressure in the piston flow channels 205 to be relieved, thereby permitting the given piston 218 and the respective pad 216 to retract toward the longitudinal axis from an extended position. The size of the fluid exhaust ports 220 can be selected to provide a desired pad retraction speed. In certain embodiments, the fluid exhaust ports 220 can include a fluid restriction, such as a choke, to limit the fluid exhaust flow and control the retraction of the piston 218 and the respective pad 216.

Within the steering assembly body 202, the turbine 204 can receive the drilling fluid flow 201 to rotate the blades of the turbine 204. The turbine 204 is coupled to the generator 206. The rotation of the generator 206 via the turbine 204 can generate electricity for use by the controller 208 and the motor 210.

The motor 210 can be an electric motor that receives generated power from the generator 206. In other embodiments, the motor 210 can be any suitable motor for rotating the control valve 230. In the depicted example, the motor 210 rotates the control valve 230 via the output shaft 212. Rotation of the output shaft 212 rotates the control valve 230 to direct the drilling fluid flow 201 as described herein.

Operation of the motor 210, and therefore the control valve 230, can be controlled by the controller 208. The controller 208 can control the rotational position, speed, and acceleration of the control valve 230 to allow for a desired steering response from the steering assembly 200. The controller 208 can relate a desired steering adjustment with a desired pad 216 actuation. The controller 208 can further relate desired pad 216 actuation with the position of the control valve 230. The controller 208 can be programmed to steer the steering assembly 200 and the drill string along a desired well plan by altering the rotational position, speed, and acceleration of the control valve 230. The controller 208 can utilize feedback mechanisms to adjust the steering of the drill string.

In certain embodiments, a standoff controller 214 can be coupled to the output shaft 212. The standoff controller 214 can axially translate the output shaft 212 within the bore of the steering assembly body 202. The axial translation of the output shaft 212 via the standoff controller 214 can be controlled by the controller 208 in accordance with a desired control scheme. In certain embodiments, the standoff controller 214 can be a hydraulic coupling to adjust the axial position of the output shaft 212. The standoff controller 214 can utilize a splined mechanism.

Figure 3A:
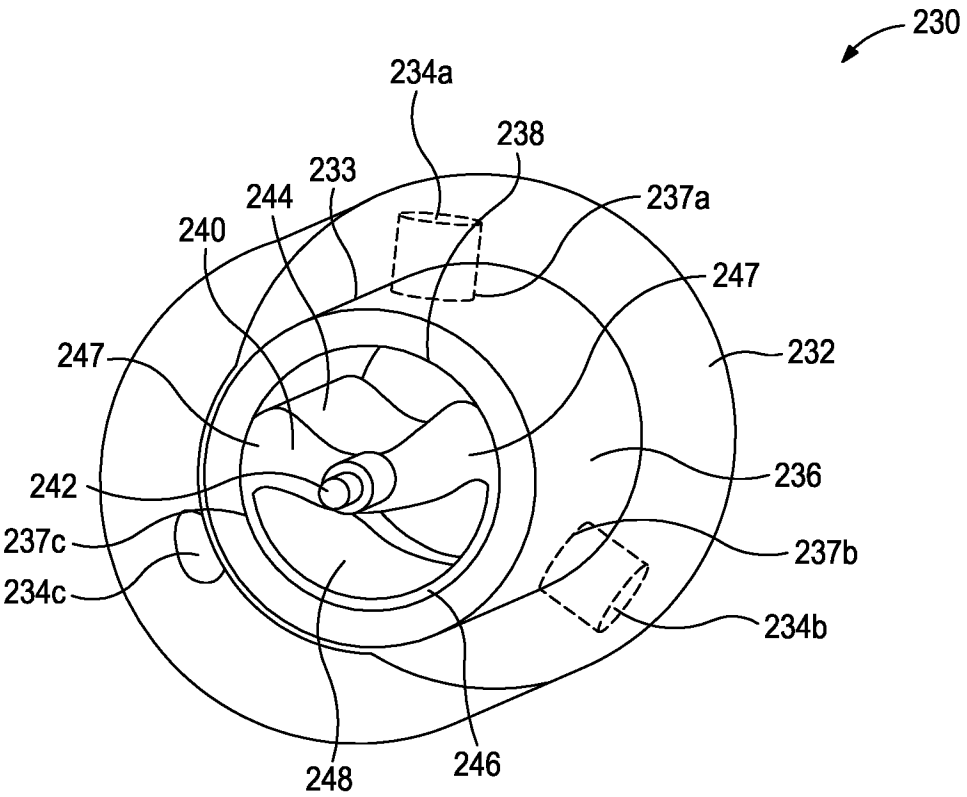
FIG. 3A is a perspective view of a control valve, according to some embodiments of the present disclosure.

FIG. 3A is an isometric view of the control valve 230. Referring to FIG. 3A, the control valve 230 can include a valve body 232, a stationary seal 236, and a rotary valve element 240 disposed within the stationary seal 236. The rotary valve element 240 can rotate within the stationary seal 236 to increase or decrease flow through the valve body 232 and the stationary seal 236 to permit actuation or prevent actuation of the pads 216.

The valve body 232 can be fixed to the steering assembly body 202 to rotate with the steering assembly 200. The valve body 232 can comprise a tubular body that includes an axial bore 233, which can optionally be centrally positioned in the valve body 232 and may be alternately referred to in that context as a central bore. The valve body 232 can include radial orifices 234*a*, 234*b*, and 234*c*, which are orifices radially formed through the walls of the valve body 232. The orifices 234*a*, 234*b*, and 234*c* extend into and are in fluid communication with the axial bore 233 of the valve body 232. The valve body 232 can include any suitable number of orifices. In certain embodiments, the valve body 232 can include a single orifice 234*a*.

In the depicted example, each of the orifices 234*a*, 234*b*, 234*c* are ported or are otherwise in fluid communication with a piston bore of a respective piston 218, wherein the respective piston 218 is coupled to a pad 216. Therefore, in the depicted example, as fluid flow is received by an orifice 234*a*, 234*b*, or 234*c*, a respective pad 216 is actuated in response to an increased fluid pressure.

The orifices 234*a*, 234*b*, and 234*c* can spaced circumferentially about the valve body 232. In certain embodiments, the orifices 234*a*, 234*b*, and 234*c* are equally spaced apart, while in other embodiments, the orifices 234*a*, 234*b*, and 234*c* can be disposed at any suitable spacing. In the depicted example, the three orifices 234*a*, 234*b*, and 234*c* are spaced apart 120 degrees along the circumference of the valve body 232.

In the depicted example, the stationary seal 236 is disposed within the axial bore 233 of the valve body 232. The stationary seal 236 can seal against the rotary valve element 240 to direct fluid flow as desired. The stationary seal 236 can have a generally cylindrical shape and comprise a seal bore 238 formed axially therethrough. The stationary seal 236 can include radial apertures 237*a*, 237*b*, and 237*c* that can be circumferentially aligned with the orifices 234*a*, 234*b*, 234*c* of the valve body 232 to allow fluid communication between the seal bore 238 and the pistons 218. For example, in the depicted example, the apertures 237*a*, 237*b*, 237*c* are aligned with the orifices 234*a*, 234*b*, and 234*c* to allow flow therebetween.

In certain embodiments, the stationary seal 236 can comprise a metal. In the depicted example, the stationary seal 236 is formed from an elastomer, such as rubber. In certain embodiments, the stationary seal 236 is formed from hydrogenated nitrile butadiene rubber.

In the depicted example, the rotary valve element 240 is disposed within the seal bore 238 of the stationary seal 236. Advantageously, by locating the rotary valve element 240 within the seal bore 238 of the stationary seal 236 a greater seal area is utilized against rotary valve element 240, thereby increasing the durability and performance of the stationary seal 236.

The rotary valve element 240 can be coupled to and driven by the motor 210 to permit the rotary valve element 240 to rotate independently of the valve body 232 and the steering assembly body 202. The rotary valve element 240 can rotate within the seal bore 238 of the stationary seal 236 to direct the drilling fluid flow 201 to orifices 234*a*, 234*b*, and 234*c* to increase or decrease the drilling fluid flow 201 to at least one piston 218 to urge the pads 216. The rotary valve element 240 can rotate via a shaft 242. In the depicted example, the shaft 242 is coupled to the output shaft 212.

The rotary valve element 240 can comprise flow-permitting and flow-blocking circumferential sections that extend about a longitudinal axis of the rotary valve element 240 and permit or block flow through the apertures 237*a*, 237*b*, 237*c* and the orifices 234*a*, 234*b*, 234*c* toward one or more of the pistons. By rotating the rotary valve element 240, the flow-permitting and flow-blocking circumferential sections can permit or block flow toward one or more of the pistons for steering the drill string.

In the depicted example, the rotary valve element 240 comprises a flow-permitting section in the form of an actuation flow channel 244 and a flow-blocking section in the form of a seal portion 246. The actuation flow channel 244 can be open toward, include one or more apertures that open toward, or otherwise permit flow to enter and pass therethrough to the apertures 237*a*, 237*b*, 237*c* and the orifices 234*a*, 234*b*, 234*c* toward one or more of the pistons. The seal portion 246 can comprise a circumferential wall that abuts or is complementary to the inner wall of the seal bore 238 in order to create a seal thereagainst and block fluid flow into and through the apertures 237*a*, 237*b*, 237*c* and the orifices 234*a*, 234*b*, 234*c*. In use, the actuation flow channel 244 can be rotated into a flow position to permit fluid flow from the seal bore 238 of the stationary seal 236 to enter an aligned orifice 234*a*, 234*b*, and/or 234*c* when the actuation flow channel 244 is aligned with the respective orifice 234*a*, 234*b*, 234*c*. Similarly, rotation of the flow channel 244 causes corresponding rotation of the seal portion 246 into a seal position to prevent fluid flow from the seal bore 238 of the stationary seal 236 into an aligned orifice 234*a*, 234*b*, and/or 234*c* when the seal portion 246 is aligned with the respective orifice 234*a*, 234*b*, 234*c*. Therefore, rotation of the rotary valve element 240 increases or decreases flow toward the piston 218.

Figure 3B:
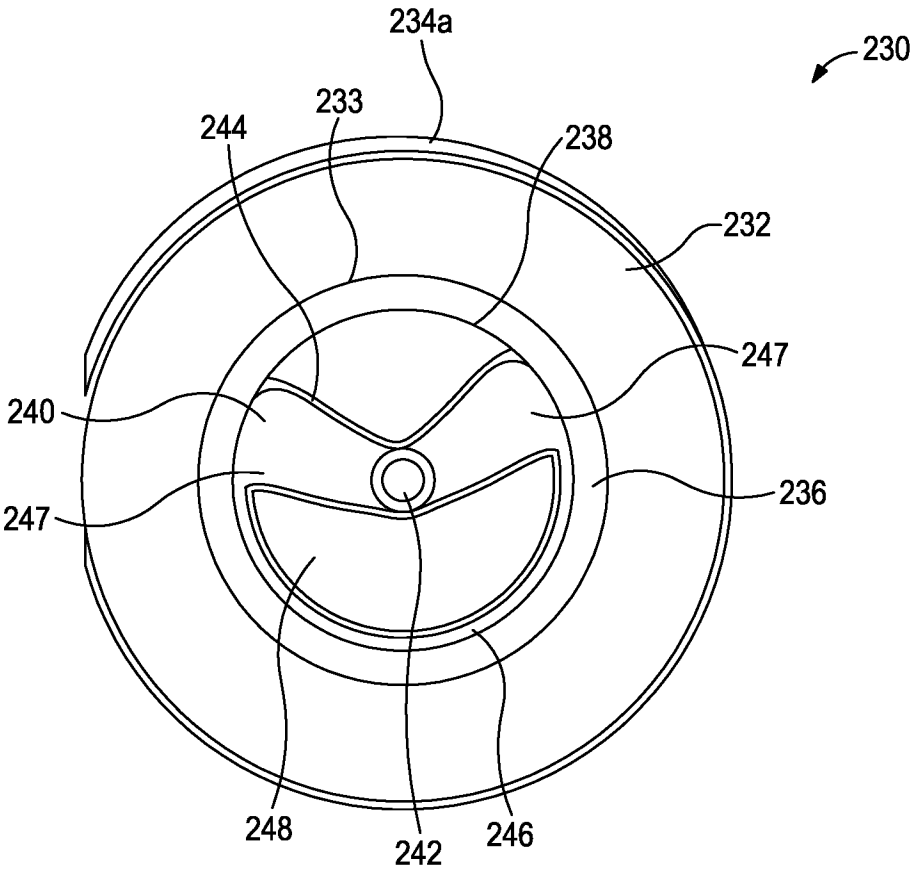
FIG. 3B is an elevation view of the control valve of FIG. 3A, according to some embodiments of the present disclosure.

FIG. 3B is an elevation view of the control valve 230. In the depicted example, as best shown in FIG. 3B, the rotary valve element 240 has an exterior profile that defines the actuation flow channel 244 formed in the rotary valve element 240. The actuation flow channel 244 can extend across at least a portion of a cross-sectional profile of the rotary valve element 240. For example, the actuation flow channel 244 can comprise a wedge-shaped void or channel. In some embodiments, when viewed in cross-section along the longitudinal axis, the actuation flow channel 244 can span a minor arc of the overall rotary valve element 240. In certain embodiments, the actuation flow channel 244 can span less than 180 degrees of the circumference of the rotary valve element 240. In other embodiments, the actuation flow channel 244 can span less than 160 degrees of the circumference of the rotary valve element 240. In other embodiments, the actuation flow channel 244 can span less than 135 degrees of the circumference of the rotary valve element 240. In other embodiments, the actuation flow channel 244 can span less than 90 degrees of the circumference of the rotary valve element 240. In some embodiments, the arcuate extent of the actuation flow channel is about 180 degrees or less.

Further, the depicted example also illustrates that the circumferential wall of the rotary valve element 240 can abut the inner surface of the seal bore 238. Similar to the actuation flow channel 244, the seal portion 246 can extend across at least a portion of the cross-sectional profile of the rotary valve element 240. For example, the seal portion 246 can comprise a portion of the circumference of the rotary valve element 240. In some embodiments, the arc of the seal portion 246 can be complimentary to the arc of the actuation flow channel 244.

In some embodiments, when viewed in cross-section along the longitudinal axis, the seal portion 246 can span a major arc of the overall rotary valve element 240. In certain embodiments, the seal portion 246 can span about 180 degrees of the circumference of the rotary valve element 240. In other embodiments, the seal portion 246 can span about 200 degrees of the circumference of the rotary valve element 240. In other embodiments, the seal portion 246 can span about 225 degrees of the circumference of the rotary valve element 240. In other embodiments, the seal portion 246 can span about 270 degrees of the circumference of the rotary valve element 240. In some embodiments, the arcuate extent of the seal portion 246 is about 180 degrees or more.

In some embodiments, the sealing portion 246 can further comprise at least one bypass flow channel 248. The bypass flow channel 248 can be formed axially through the rotary valve element 240 to permit fluid communication from upstream of the control valve 230 to downstream of the control valve 230. The bypass flow channel 248 can allow constant flow through the rotary valve element 240 to allow flow to continue downhole of the control valve 230. As also shown, the sealing portion 246 of the rotary valve element 240 can comprise at least one spoke or radial connector 247 that extends radially to the inner surface of the seal bore 238 to contact the circumferential wall thereagainst to block flow into and through the apertures 237*a*, 237*b*, 237*c* and the orifices 234*a*, 234*b*, 234*c* when aligned therewith. The arcuate or circumferential width of the radial connector 247 can vary as desired (to permit more or less resistance to flow past the control valve 230 and/or toward the pistons).

Advantageously, by disposing the rotary valve element 240 within the stationary seal 236, the control valve 230 avoids the use of complex dynamic sealing techniques. Further, the relatively large open bore area of the actuation flow channel 244 and the bypass flow channel 248 can minimize pressure drop.

During operation, the control valve 230 allows for isolated actuation of pistons 218 while sealing or isolating pistons 218 as desired by the control scheme implemented by the controller 208 and the rotation imparted by motor 210.

Figure 4B:
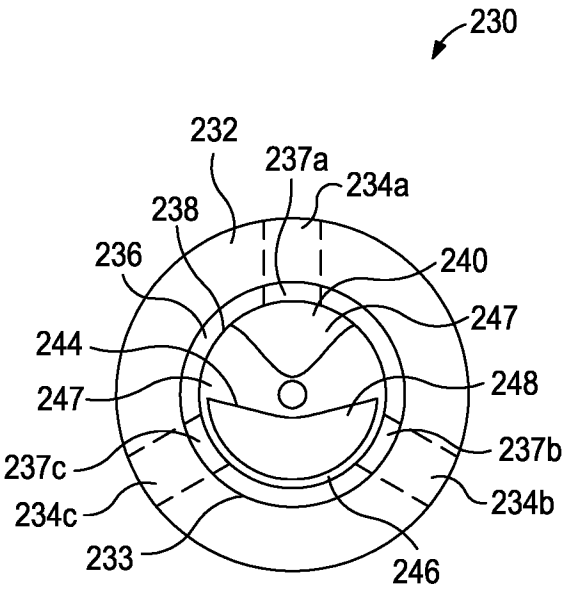
FIG. 4B is an elevation view of a control valve, according to some embodiments of the present disclosure.
Figure 4A:
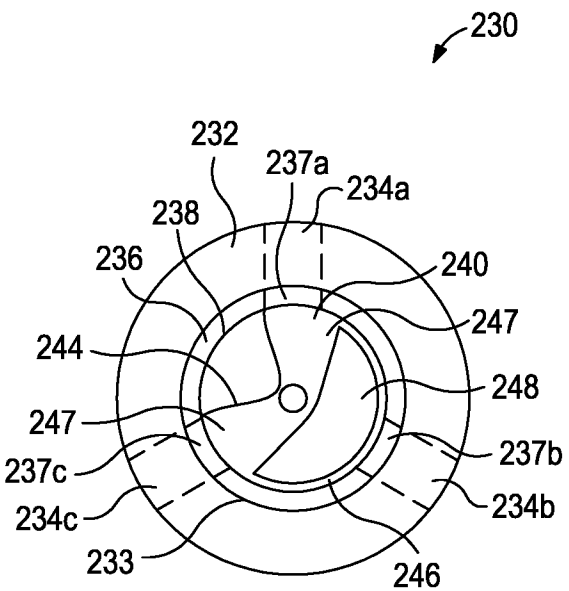
FIG. 4A is an elevation view of a control valve, according to some embodiments of the present disclosure.

FIG. 4A is an elevation view of the control valve 230 wherein an example of the operation of the control valve 230 is shown. FIG. 4A shows an elevation view of the control valve 230 in a seal position, wherein the rotary valve element 240 is rotated to a position that aligns the seal portion 246 to block the orifices 234*a*, 234*b*, and 234*c*. In this position, flow is not allowed to any of the orifices 234*a*, 234*b*, or 234*c*. However, bypass flow can continue through the control valve 230 via the bypass flow channel 248. Further, bypass flow can flow through the actuation flow channel 244 through the control valve 230. Bypass flow can be directed to the drill bit 114, as shown in FIG. 2, disposed below the control valve 230.

FIG. 4B is an elevation view of the control valve 230 wherein an example of the operation of the control valve 230 is shown. Referring to FIG. 4B, the control valve 230 is shown with the rotary valve element 240 aligned with the orifice 234*a* in a flow position. In the depicted example, the rotary valve element 240 is alignable in a flow position when the actuation flow channel 244 is aligned with at least one of the orifices 234*a*, 234*b*, and 234*c*.

Figure 5:
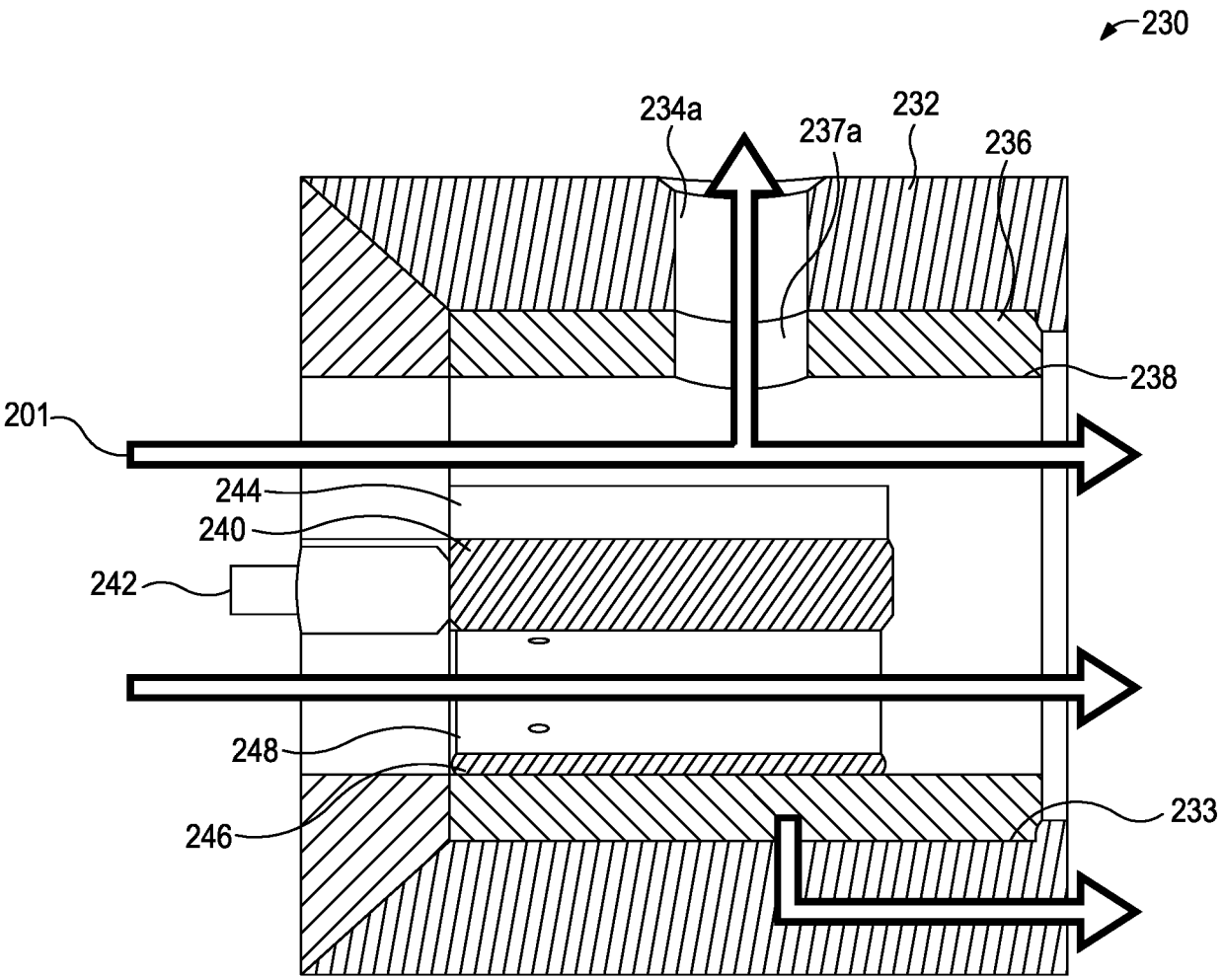
FIG. 5 is a sectional view of the control valve of FIG. 4B, according to some embodiments of the present disclosure.

FIG. 5 shows a fluid flow through the control valve 230 when the rotary valve element 240 is in a flow position. As shown, when the actuation flow channel 244 is aligned with the orifice 234*a* flow is allowed to enter the orifice 234*a*. As a result, drilling fluid flow 201 can actuate a piston 218, shown in FIG. 2, associated with the orifice 234*a*. Bypass fluid flow can flow through the bypass fluid channel 248.

Further, as the rotatory valve element 240 is in the flow position with respect to the orifice 234*a*, the rotary valve element 240 exposes the sealing portion 246 to the orifices 234*b* and 234*c*. Therefore, in this example, the orifices 234*b* and 234*c* and their respective pistons 218 are not actuated.

During operation, the rotary valve element 240 can rotate and align the actuation flow channel 244 with each of the orifices 234*a*, 234*b*, and 234*c* while simultaneously sealing off select orifices 234*a*, 234*b*, 234*c*.

Figure 6:
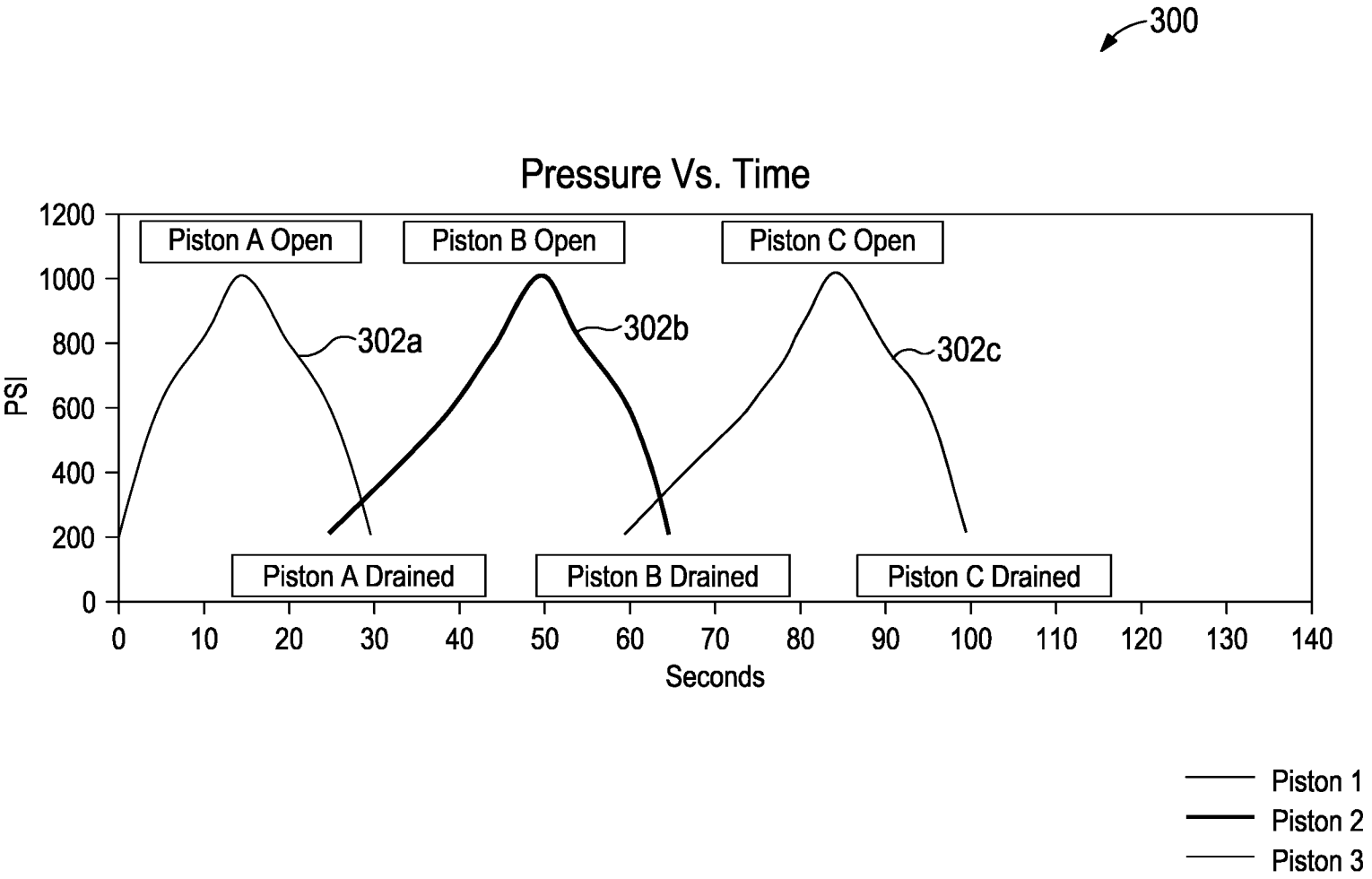
FIG. 6 is a graph of piston pressure over time, according to some embodiments of the present disclosure.

FIG. 6 shows an example of pressure experienced by the pistons 218 shown in FIG. 2 as the control valve 230 shown in FIGS. 4A and 4B is operated. In the depicted example, the control valve 230 is rotated at a constant rotational speed to provide equal fluid pressure exposure to the equidistantly oriented orifices 234*a*, 234*b*, and 234*c*. As illustrated, piston pressure over time is shown for three pistons as curves 302*a*, 302*b*, and 302*c*, which correspond to fluid pressure provided by the orifices 234*a*, 234*b*, and 234*c* of the control valve 230. In the graph 300, as the first piston 302*a* is exposed to fluid pressure as the orifice 234*a* is aligned with the actuation flow channel 244, pressure experienced by the piston 302*a* increases over time. As the actuation flow channel 244 is rotated out of alignment with the orifice 234*a*, fluid pressure experienced by the piston 302*a* drops, as fluid leaves through the fluid exhaust ports 220, shown in FIG. 2. Similarly, pistons 302*b* and 302*c* increase and decay in pressure as the respective orifice 234*b* or 234*c* is aligned with the actuation flow channel 244.

While the graph 300 represents the pressure experienced by pistons 302*a*, 302*b* and 302*c* as the control valve 230 rotates at a constant RPM via the motor 210, the controller 208, shown in FIG. 2, can alter the rotation of the control valve 230 to provide a desired performance or effect, such as steering the drill string in a desired direction or provide a desired stability target. In certain embodiments, the control valve 230 rotation can be altered for additional objectives, such as breaking obstructions in the formation, avoiding stick-slip, or minimizing actuation of failed or faulty pads.

In certain embodiments, the rotational speed of the rotary valve element 240 can be altered to vary the duty cycle of each piston 302*a*, 302*b*, 302*c* and subsequently the associated pads. As the rotational speed of the rotary valve element 240 is altered, the actuation flow channel 244 can be aligned to a flow position for less time per revolution.

Angular acceleration of the rotary valve element 240 can be varied by the controller 208 to allow the actuation flow channel 244 to dwell in a flow position aligned with select orifices 234*a*, 234*b*, and 234*c* to increase a select pad actuation time. Similarly, the rotary valve element 240 can accelerate past a specific select orifice 234*a*, 234*b*, 234*c* to minimize a pad actuation. In certain embodiments, angular acceleration of the rotary valve element 240 can be utilized to provide a linear or nonlinear response independent of the shape of the orifices 234*a*, 234*b*, and 234*c*. Further, the actuation flow channel 244 can be jittered back and forth to provide a desired pressure response characteristic to actuate a desired pad with a desired movement profile.

Figure 7B:
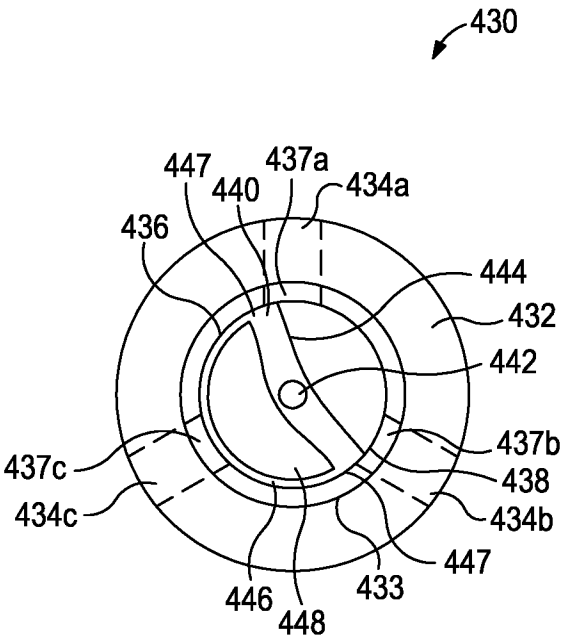
FIG. 7B is an elevation view of a control valve, according to some embodiments of the present disclosure.
Figure 7A:
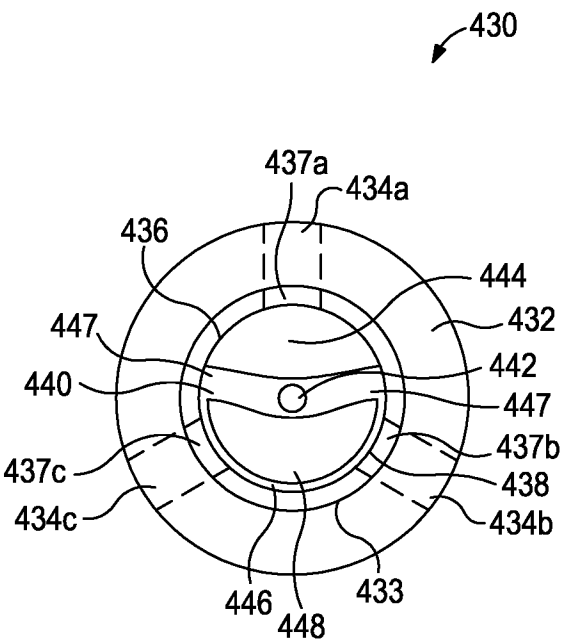
FIG. 7A is an elevation view of a control valve, according to some embodiments of the present disclosure.

FIGS. 7A and 7B are elevation views of the control valve 430. Elements in FIGS. 7A and 7B are labeled such that similar elements are referred to with similar reference numerals with exceptions as noted. In the depicted example, the rotary valve element 440 has larger actuation flow channel 444 compared to the actuation flow channel 244 of rotary valve element 240 (FIGS. 4A and 4B). The actuation flow channel 444 can direct drilling fluid flow 201, shown in FIG. 2, to multiple orifices 434*a*, 434*b*, and 434*c* in selected multiple flow positions. Similarly, the size of the seal portion 446 compliments the larger actuation flow channel 444 and has been reduced and can only block one or two orifices 434*a*, 434*b*, and/or 434*c*.

FIG. 7A shows an elevation view of the control valve 430 in a single flow position, wherein the rotary valve element 440 is rotated to a position that aligns the actuation flow channel 444 with a single orifice 434*a*. In the depicted example, the rotary valve element 440 is alignable in a single flow position when the actuation flow channel 444 is aligned with only one of the orifices 434*a*, 434*b*, and 434*c*. As shown, when the actuation flow channel 444 is aligned with the orifice 434*a* flow is allowed to enter the orifice 434*a*. As a result, drilling fluid flow 201 can actuate a piston 218, shown in FIG. 2, associated with the orifice 434*a*. Bypass fluid flow can flow through the bypass fluid channel 448.

Further, as the rotary valve element 440 is in the single flow position with respect to the orifice 434*a*, the rotary valve element 440 exposes the sealing portion 446 to the orifices 434*b* and 434*c*. Therefore, in this example, the orifices 434*b* and 434*c* and their respective pistons 218 are not actuated.

In reference to FIG. 7B, the control valve 430 is shown with the rotary valve element 440 aligned with the orifices

434*a* and 434*b* in a multiple flow position. In the depicted example, the rotary valve element 440 is alignable in a multiple flow position when the actuation flow channel 444 is aligned with at least two of the orifices 434*a*, 434*b*, and 434*c*. As shown, when the actuation flow channel 444 is aligned with orifices 434*a* and 434*b* flow is allowed to enter the orifices 434*a* and 434*b*. As a result, drilling fluid flow 201 can actuate a pistons 218, shown in FIG. 2, associated with the orifice 434*a* and 434*b*. Bypass fluid flow can flow through the bypass fluid channel 448.

Further, as the rotary valve element 440 is in the multiple flow position with respect to the orifices 434*a* and 434*b*, the rotary valve element 440 exposes the sealing portion 446 to the orifice 434*c*. Therefore, in this example, the orifice 434*c* and the respective piston 218 is not actuated.

During operation, the rotary valve element 440 can rotate and align the actuation flow channel 444 with each of the orifices 434*a*, 434*b*, and 434*c* while simultaneously sealing off select orifices 434*a*, 434*b*, 434*c*.

Figure 8:
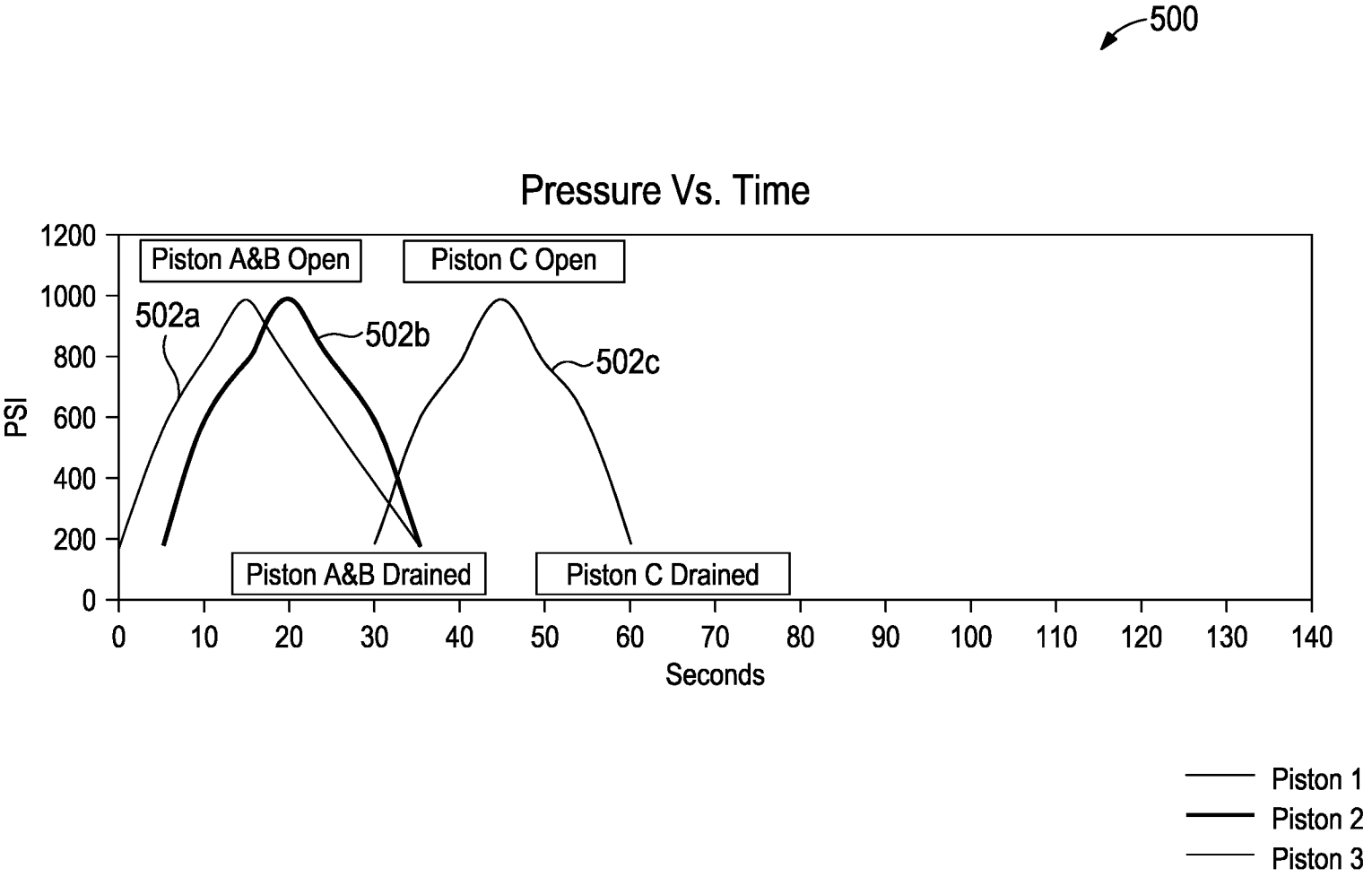
FIG. 8 is a graph of piston pressure over time, according to some embodiments of the present disclosure.

FIG. 8 shows an example of pressure experienced by the pistons 218, shown in FIG. 2, as the control valve 430 shown in FIGS. 7A and 7B is operated. In the depicted example, the control valve 430 is rotated at a constant rotational speed to provide fluid pressure exposure to the equidistantly oriented orifices 434*a*, 434*b*, and 434*c*. As illustrated, piston pressure over time is shown for three pistons as curves 502*a*, 502*b*, and 502*c*, which correspond to fluid pressure provided by the orifices 434*a*, 434*b*, and 434*c* of the control valve 430. In the graph 500, as the first piston 502*a* is exposed to fluid pressure as the orifice 434*a* is aligned with the actuation flow channel 444, pressure experienced by the piston 502*a* increases over time. As the actuation flow channel 444 moves from a single flow position to a multiple flow position, the second piston 502*b* increases in pressure while the first piston pressure 502*b* remains elevated. As the actuation flow channel 444 is rotated out of alignment with the orifice 434*a*, fluid pressure experienced by the piston 502*a* drops, as fluid leaves through the fluid exhaust ports 220. Similarly, pistons 502*b* and 502*c* increase and decay in pressure as the respective orifice 434*b* or 434*c* is aligned with the actuation flow channel 444, allowing for multiple pads to be actuated at approximately the same time.

While the graph 500 represents the pressure experienced by pistons 502*a*, 502*b* and 502*c* as the control valve 430 rotates at a constant RPM via the motor 210, the controller 208, shown in FIG. 2, can alter the rotation of the control valve 430 to provide a desired performance or effect, as previously described herein.

Figure 9:
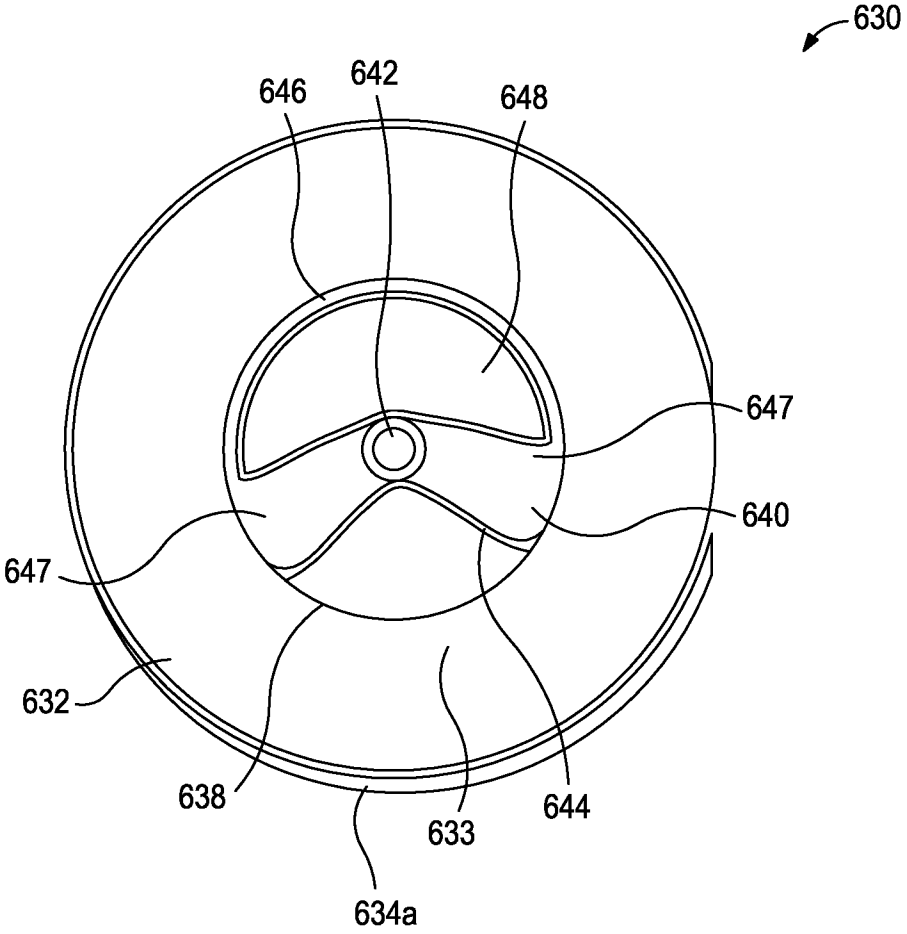
FIG. 9 is an elevation view of a control valve, according to some embodiments of the present disclosure.

FIG. 9 is an elevation view of a control valve 630. Elements in FIG. 9 are labeled such that similar elements are referred to with similar reference numerals with exceptions as noted. In the depicted example, the rotary valve element 640 seals directly against the axial bore 633. The rotary valve element 640 and the axial bore 633 can provide a metal to metal sealing relationship therebetween.

Various examples of aspects of the disclosure are described below as clauses for convenience. These are provided as examples, and do not limit the subject technology.

Clause 1. A control valve for steering a drill string, the control valve comprising: a valve body including an axial bore and a radial orifice in fluid communication with the axial bore, wherein flow passing through the axial bore passes through the radial orifice and into a piston flow channel to be in fluid communication with a piston bore to exert pressure against a piston movable within the piston bore, the piston being coupled a steering pad for applying force against the wellbore wall to steer a direction of the drill string; and a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston.

Clause 2. The control valve of Clause 1, wherein the rotary valve element includes a bypass flow channel formed axially through the rotary valve element to provide flow through the axial bore and away from the piston.

Clause 3. The control valve of Clause 2, wherein the bypass flow channel is bounded by a circumferential wall of the rotary valve element, the circumferential wall abutting the seal bore when disposed therewithin.

Clause 4. The control valve of any preceding clause, further including a stationary seal member disposed within the axial bore of the valve body and defining an axial seal bore and a radial aperture in fluid communication with the radial orifice.

Clause 5. The control valve of any preceding clause, wherein the axial bore includes a central bore.

Clause 6. The control valve of any preceding clause, wherein a cross-sectional profile of the actuation flow channel, taken along a longitudinal axis of the rotary valve element, extends along a minor arc of the axial bore.

Clause 7. The control valve of any preceding clause, wherein the cross-sectional profile of the actuation flow channel extends along an arc of less than 180 degrees.

Clause 8. The control valve of any preceding clause, wherein the cross-sectional profile of the actuation flow channel extends along an arc of less than 160 degrees.

Clause 9. The control valve of any preceding clause, wherein the cross-sectional profile of the actuation flow channel extends along an arc of less than 135 degrees.

Clause 10. The control valve of any preceding clause, wherein the cross-sectional profile of the actuation flow channel extends along an arc of less than 90 degrees.

Clause 11. The control valve of Clause 2, wherein a cross-sectional profile of the bypass flow channel, taken along a longitudinal axis of the rotary valve element, extends along a major arc of the axial bore.

Clause 12. The control valve of Clause 11, wherein the cross-sectional profile of the bypass flow channel extends along an arc of at least about 180 degrees.

Clause 13. The control valve of Clause 11, wherein the cross-sectional profile of the bypass flow channel extends along an arc of at least about 200 degrees.

Clause 14. The control valve of Clause 11, wherein the cross-sectional profile of the bypass flow channel extends along an arc of at least about 225 degrees.

Clause 15. The control valve of Clause 11, wherein the cross-sectional profile of the bypass flow channel extends along an arc of at least about 270 degrees.

Clause 16. The control valve of any preceding clause, wherein the at least one radial orifice is circumferentially equidistantly spaced about the valve body.

Clause 17. The control valve of any preceding clause, wherein the stationary seal member includes a metal body.

Clause 18. The control valve of Clause 4, wherein the stationary seal member includes an elastomeric body.

Clause 19. The control valve of Clause 18, wherein the elastomeric body includes hydrogenated nitrile butadiene rubber.

Clause 20. The control valve of any preceding clause, wherein the at least one radial orifice includes a single radial orifice.

Clause 21. The control valve of any preceding clause, wherein the at least one radial orifice includes two radial orifices.

Clause 22. The control valve of Clause 21, wherein the flow position provides flow to a first radial orifice and away from a second radial orifice.

Clause 23. The control valve of any preceding clause, wherein the at least one radial orifice includes first, second, and third radial orifices.

Clause 24. The control valve of Clause 23, wherein the first, second, and third radial orifices are circumferentially spaced apart from each other along an inner surface of the axial bore at an arc length of about 120 degrees.

Clause 25. The control valve of Clause 23, wherein in the flow position, the rotary valve element permits flow to the first radial orifice while blocking flow to the second and third radial orifices.

Clause 26. The control valve of Clause 23, wherein in the flow position, the rotary valve element permits flow to the first and second radial orifices while blocking flow to the third radial orifice.

Clause 27. The control valve of any preceding clause, wherein the rotary valve element is rotated by an electric motor.

Clause 28. A rotary steering device for steering a drill string, the rotary steering device comprising: a device body; a plurality of pads associated with an outer surface of the device body; a plurality of pistons operatively coupled to the plurality of pads to actuate the plurality of pads; and a control valve disposed within the device body, the control valve including: a valve body including an axial bore and a radial orifice in fluid communication with the axial bore, wherein flow passing through the axial bore passes through the radial orifice and into a piston flow channel to be in fluid communication with a piston bore to exert pressure against a piston of the plurality of pistons movable within the piston bore, the piston being coupled a steering pad for applying force against the wellbore wall to steer a direction of the drill string; and a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston.

Clause 29. The rotary steering device of Clause 28, wherein the rotary valve element includes a bypass flow channel formed axially through the rotary valve element to provide flow through the axial bore and away from the piston.

Clause 30. The rotary steering device of Clause 29, wherein the bypass flow channel is bounded by a circumferential wall of the rotary valve element, the circumferential wall abutting the axial bore when disposed therewithin.

Clause 31. The rotary steering device of Clause 28, further including a stationary seal member disposed within the axial bore of the valve body and defining an axial seal bore and a radial aperture in fluid communication with the radial orifice.

Clause 32. The rotary steering device of Clause 28, wherein the axial bore includes a central bore.

Clause 33. The rotary steering device of Clause 28, wherein a cross-sectional profile of the actuation flow channel, taken along a longitudinal axis of the rotary valve element, extends along a minor arc of the axial bore.

Clause 34. The rotary steering device of Clause 33, wherein the cross-sectional profile of the actuation flow channel extends along an arc of less than 180 degrees.

Clause 35. The rotary steering device of Clause 33, wherein the cross-sectional profile of the actuation flow channel extends along an arc of less than 160 degrees.

Clause 36. The rotary steering device of Clause 33, wherein the cross-sectional profile of the actuation flow channel extends along an arc of less than 135 degrees.

Clause 37. The rotary steering device of Clause 33, wherein the cross-sectional profile of the actuation flow channel extends along an arc of less than 90 degrees.

Clause 38. The rotary steering device of Clause 30, wherein a cross-sectional profile of the bypass flow channel, taken along a longitudinal axis of the rotary valve element, extends along a major arc of the axial bore.

Clause 39. The rotary steering device of Clause 38, wherein the cross-sectional profile of the bypass flow channel extends along an arc of at least about 180 degrees.

Clause 40. The rotary steering device of Clause 38, wherein the cross-sectional profile of the bypass flow channel extends along an arc of at least about 200 degrees.

Clause 41. The rotary steering device of Clause 38, wherein the cross-sectional profile of the bypass flow channel extends along an arc of at least about 225 degrees.

Clause 42. The rotary steering device of Clause 38, wherein the cross-sectional profile of the bypass flow channel extends along an arc of at least about 270 degrees.

Clause 43. The rotary steering device of any Clause 28-42, wherein the at least one radial orifice is circumferentially equidistantly spaced about the valve body.

Clause 44. The rotary steering device of Clause 31, wherein the stationary seal member includes a metal body.

Clause 45. The rotary steering device of Clause 31, wherein the stationary seal member includes an elastomeric body.

Clause 46. The rotary steering device of Clause 45, wherein the elastomeric body includes hydrogenated nitrile butadiene rubber.

Clause 47. The rotary steering device of any Clause 28-46, wherein the at least one radial orifice includes one radial orifice.

Clause 48. The rotary steering device of any Clause 28-47, wherein the at least one radial orifice includes two radial orifices.

Clause 49. The rotary steering device of Clause 48, wherein the flow position provides flow to a first radial orifice and away from a second radial orifice.

Clause 50. The rotary steering device of any Clause 28-49, wherein the at least one radial orifice includes first, second, and third radial orifices.

Clause 51. The rotary steering device of Clause 50, wherein the first, second, and third radial orifices are circumferentially spaced apart from each other along an inner surface of the seal bore at an arc length of about 120 degrees.

Clause 52. The rotary steering device of Clause 50, wherein in the flow position, the rotary valve element permits flow to the first radial orifice while blocking flow to the second and third radial orifices.

Clause 53. The rotary steering device of Clause 50, wherein in the flow position, the rotary valve element permits flow to the first and second radial orifices while blocking flow to the third radial orifice.

Clause 54. The rotary steering device of any Clause 28-53, wherein the rotary valve element is rotated by an electric motor.

Clause 55. A method of steering a drill string, the method comprising: drilling into a subterranean formation with a drill bit operatively coupled to a rotary steering device, the rotary steering device including a rotary valve element rotatable within a valve body, the rotary valve element including a bypass flow channel and an actuation flow channel; and rotating the rotary valve element with respect to a radial orifice extending through the valve body to modify fluid flow through the radial orifice toward a piston for urging a pad via the piston to steer the drill string.

Clause 56. The method of Clause 55, further including altering an azimuthal tool face orientation of the drill bit.

Clause 57. The method of Clause 55 or 56, further including providing fluid flow to the drill bit via a bypass flow channel formed axially through the rotary valve element.

Clause 58. The method of any Clause 55-57, wherein the rotating includes moving the rotary valve element to a flow position to permit flow through the radial orifice.

Clause 59. The method of Clause 58, wherein the radial orifice is a first radial orifice, and the rotary steering device includes a second radial orifice extending through the axial member and the valve body, and wherein the rotating includes moving the rotary valve element to the flow position to permit flow through the radial orifice and the second radial orifice.

Clause 60. The method of Clause 58, wherein the radial orifice is a first radial orifice, and the rotary steering device includes a second radial orifice extending through the axial member and the valve body, and wherein the rotating includes moving the rotary valve element to the flow position to permit flow through the first radial orifice while blocking flow through the second radial orifice.

Clause 61. The method of Clause 58, wherein the radial orifice is a first radial orifice, and the rotary steering device includes a second radial orifice extending through the axial member and the valve body, and wherein the rotating includes moving the rotary valve element away from the flow position to block flow through the first and second radial orifices.

Clause 62. The method of Clause 58, wherein the radial orifice is a first radial orifice, and the rotary steering device includes second and third radial orifices extending through the axial member and the valve body, and wherein the rotating includes moving the rotary valve element to the flow position to permit flow through the first and second radial orifices while blocking flow through the third radial orifice.

Clause 63. The method of Clause 58, wherein the radial orifice is a first radial orifice, and the rotary steering device includes second and third radial orifices extending through the axial member and the valve body, and wherein the rotating includes moving the rotary valve element to the flow position to permit flow through the first radial orifice while blocking flow through the second and third radial orifices.

Clause 64. The method of Clause 58, wherein the radial orifice is a first radial orifice, and the rotary steering device includes second and third radial orifices extending through the axial member and the valve body, and wherein the rotating includes moving the rotary valve element away from the flow position to block flow through the first, second, and third radial orifices.

What is claimed is:

1. A control valve for steering a drill string, the control valve comprising:

a valve body including an axial bore and a radial orifice in fluid communication with the axial bore, wherein flow passing through the axial bore passes through the radial orifice and into a piston flow channel to be in fluid communication with a piston bore to exert pressure against a piston movable within the piston bore, the piston being coupled a steering pad for applying force against the wellbore wall to steer a direction of the drill string; and a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston, the rotary valve element comprising at least one spoke to vary the flow through the control valve, the at least one spoke extending radially from a shaft.

2. The control valve of claim 1, wherein the rotary valve element includes a bypass flow channel formed axially through the rotary valve element to provide flow through the axial bore and away from the piston.

3. The control valve of claim 2, wherein a cross-sectional profile of the bypass flow channel, taken along a longitudinal axis of the rotary valve element, extends along a major arc of the axial bore.

4. The control valve of claim 1, further including a stationary seal member disposed within the axial bore of the valve body and defining an axial seal bore and a radial aperture in fluid communication with the radial orifice.

5. The control valve of claim 4, wherein the stationary seal member includes an elastomeric body.

6. The control valve of claim 1, wherein the axial bore includes a central bore.

7. The control valve of claim 1, wherein a cross-sectional profile of the actuation flow channel, taken along a longitudinal axis of the rotary valve element, extends along a minor arc of the axial bore.

8. The control valve of claim 1, wherein the radial orifice includes first, second, and third radial orifices.

9. The control valve of claim 8, wherein in the flow position, the rotary valve element permits flow to the first radial orifice while blocking flow to the second and third radial orifices.

10. The control valve of claim 8, wherein in the flow position, the rotary valve element permits flow to the first and second radial orifices while blocking flow to the third radial orifice.

11. The control valve of claim 1, wherein the rotary valve element is rotated by an electric motor.

12. A rotary steering device for steering a drill string, the rotary steering device comprising:

a device body;

a plurality of steering pads associated with an outer surface of the device body;

a plurality of pistons operatively coupled to the plurality of pads to actuate the plurality of pads; and a control valve disposed within the device body, the control valve including:

a valve body including an axial bore and a radial orifice in fluid communication with the axial bore, wherein flow passing through the axial bore passes through the radial orifice and into a piston flow channel to be in fluid communication with a piston bore to exert pressure against a piston of the plurality of pistons movable within the piston bore, the piston being coupled a steering pad for applying force against the wellbore wall to steer a direction of the drill string; and a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston, the rotary valve element comprising at least one spoke to vary the flow through the control valve, the at least one spoke extending radially from a shaft.

13. The rotary steering device of claim 12, wherein the rotary valve element includes a bypass flow channel formed axially through the rotary valve element to provide flow through the axial bore and away from the piston.

14. The rotary steering device of claim 13, wherein the bypass flow channel is bounded by a circumferential wall of the rotary valve element, the circumferential wall abutting the axial bore when disposed therewithin.

15. The rotary steering device of claim 12, further including a stationary seal member disposed within the axial bore of the valve body and defining an axial seal bore and a radial aperture in fluid communication with the radial orifice.

16. The rotary steering device of claim 12, wherein the axial bore includes a central bore.

17. A method of steering a drill string, the method comprising:

drilling into a subterranean formation with a drill bit operatively coupled to a rotary steering device, the rotary steering device including a rotary valve element rotatable within a valve body, the rotary valve element including a bypass flow channel and an actuation flow channel; and rotating the rotary valve element with respect to a radial orifice extending through the valve body to modify fluid flow through the radial orifice toward a piston for urging a pad via the piston to steer the drill string, the rotary valve element comprising at least one spoke to vary the fluid flow through the valve body, the at least one spoke extending radially from a shaft.

18. The method of claim 17, further including providing fluid flow to the drill bit via a bypass flow channel formed axially through the rotary valve element.

19. The method of claim 17, wherein the rotating includes moving the rotary valve element to a flow position to permit flow through the radial orifice.

20. The method of claim 17, further comprising rotating the at least one spoke to vary the fluid flow through the actuation flow channel.

21. A control valve for steering a drill string, the control valve comprising:

a valve body including an axial bore and a radial orifice in fluid communication with the axial bore, wherein flow passing through the axial bore passes through the radial orifice and into a piston flow channel to be in fluid communication with a piston bore to exert pressure against a piston movable within the piston bore, the piston being coupled a steering pad for applying force against the wellbore wall to steer a direction of the drill string;

a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston; and a stationary seal member disposed within the axial bore of the valve body and defining an axial seal bore and a radial aperture in fluid communication with the radial orifice.

22. A control valve for steering a drill string, the control valve comprising:

a valve body including an axial bore and a radial orifice in fluid communication with the axial bore, wherein flow passing through the axial bore passes through the radial orifice and into a piston flow channel to be in fluid communication with a piston bore to exert pressure against a piston movable within the piston bore, the piston being coupled a steering pad for applying force against the wellbore wall to steer a direction of the drill string;

a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston; and a stationary seal member disposed within the axial bore of the valve body and defining an axial seal bore and a radial aperture in fluid communication with the radial orifice, wherein the stationary seal member includes an elastomeric body.

23. A rotary steering device for steering a drill string, the rotary steering device comprising:

a device body;

a plurality of steering pads associated with an outer surface of the device body;

a plurality of pistons operatively coupled to the plurality of pads to actuate the plurality of pads; and a control valve disposed within the device body, the control valve including:

a valve body including an axial bore and a radial orifice in fluid communication with the axial bore, wherein flow passing through the axial bore passes through the radial orifice and into a piston flow channel to be in fluid communication with a piston bore to exert pressure against a piston of the plurality of pistons movable within the piston bore, the piston being coupled a steering pad for applying force against the wellbore wall to steer a direction of the drill string;

a rotary valve element disposed within the axial bore and including an actuation flow channel, wherein the rotary valve element is rotatable with respect to the axial bore to change flow through the actuation channel and the radial orifice to modify fluid pressure within the piston flow channel that is exerted against the piston, the rotary valve element being rotatable relative to the valve body to increase or decrease flow toward the piston for controlling actuation of the piston; and a stationary seal member disposed within the axial bore of the valve body and defining an axial seal bore and a radial aperture in fluid communication with the radial orifice.

* * * * *